US007229324B2

(12) United States Patent
van der Steen

(10) Patent No.: US 7,229,324 B2
(45) Date of Patent: Jun. 12, 2007

(54) HIGH SPEED RECEPTACLE CONNECTOR PART

(75) Inventor: Hendrikus Petrus Gijsbertus van der Steen, Den Dungen (NL)

(73) Assignee: FCI SA, Versailles (FR)

( * ) Notice: Subject to any disclaimer, the term of this patent is extended or adjusted under 35 U.S.C. 154(b) by 0 days.

(21) Appl. No.: 10/818,814

(22) Filed: Apr. 6, 2004

(65) Prior Publication Data

US 2005/0221686 A1 Oct. 6, 2005

(51) Int. Cl.
*H01R 13/10* (2006.01)

(52) U.S. Cl. ..... 439/682; 439/857

(58) Field of Classification Search ..... 439/857, 439/856, 682, 636
See application file for complete search history.

(56) References Cited

U.S. PATENT DOCUMENTS

| | | | | |
|---|---|---|---|---|
| 2,476,510 A | | 7/1949 | Rosner | 439/265 |
| 3,594,699 A | | 7/1971 | Jayne | 339/75 |
| 3,646,500 A | | 2/1972 | Wesseley | 339/65 |
| 3,671,917 A | | 6/1972 | Ammon et al. | 339/17 |
| 3,737,838 A | | 6/1973 | Mattingly, Jr. et al. | 339/186 |
| 3,865,462 A | * | 2/1975 | Cobaugh et al. | 439/748 |
| 4,140,361 A | * | 2/1979 | Sochor | 439/682 |
| 4,217,024 A | | 8/1980 | Aldridge et al. | 339/275 |
| 4,420,215 A | * | 12/1983 | Tengler | 439/723 |
| 4,591,230 A | * | 5/1986 | Roldan | 439/856 |
| 4,752,246 A | | 6/1988 | Triner et al. | 439/682 |
| 4,772,396 A | | 9/1988 | Voyt | 210/605 |
| 5,009,618 A | | 4/1991 | Black et al. | 439/736 |
| 5,137,462 A | * | 8/1992 | Casey et al. | 439/74 |
| 5,162,002 A | | 11/1992 | Regnier | 439/637 |
| 5,334,053 A | * | 8/1994 | Noschese | 439/682 |
| 5,389,010 A | | 2/1995 | Takano et al. | 439/565 |
| 5,399,108 A | * | 3/1995 | Lu et al. | 439/682 |
| 5,475,922 A | | 12/1995 | Tamura et al. | 29/881 |
| 5,551,883 A | | 9/1996 | Davis | 439/65 |
| 5,569,053 A | | 10/1996 | Nelson et al. | 439/668 |
| 5,609,502 A | | 3/1997 | Thumma | 439/747 |
| 5,672,084 A | | 9/1997 | Feldman | 439/852 |
| 5,675,582 A | | 10/1997 | Hummel et al. | 370/255 |
| 5,679,018 A | | 10/1997 | Lopata et al. | 439/260 |
| 5,704,800 A | | 1/1998 | Sato et al. | 439/342 |
| 5,719,977 A | | 2/1998 | Lampert et al. | 385/60 |
| 6,019,521 A | | 2/2000 | Manning et al. | 385/77 |

(Continued)

FOREIGN PATENT DOCUMENTS

EP 0 977 319 A2 2/2000

(Continued)

*Primary Examiner*—Xuong Chung-Trans
(74) *Attorney, Agent, or Firm*—Woodcock Washburn LLP

(57) ABSTRACT

A receptacle connector part comprises a connector housing and a plurality of rows of receptacle contact terminals disposed within the housing. Each receptacle contact terminal includes two single beam contacts having contact portions with a preloading head. The connector housing comprises a front wall with a plurality of rows of apertures providing access to the contact portions of the contact terminals. The connector housing is provided with a plurality of rows of preload ridges, the preload ridges being located at the inner side of the front wall at opposed sides of the apertures. The preload ridges cooperate with the preloading heads to support the contact portions of the single beam contacts of each contact terminal in a predetermined preload position.

33 Claims, 9 Drawing Sheets

U.S. PATENT DOCUMENTS

| | | | | |
|---|---|---|---|---|
| 6,050,836 | A | 4/2000 | Tohyama | 439/266 |
| 6,080,001 | A | 6/2000 | Wong | 439/344 |
| 6,149,315 | A | 11/2000 | Stephenson | 385/60 |
| 6,254,278 | B1 | 7/2001 | Andrews et al. | 385/53 |
| 6,264,490 | B1 | 7/2001 | Lemke et al. | 439/342 |
| 6,345,999 | B1 | 2/2002 | Okuyama et al. | 439/268 |
| 6,371,772 | B1 | 4/2002 | Yoneyama et al. | 439/79 |
| 6,595,791 | B2 | 7/2003 | Below et al. | 439/271 |
| 6,652,318 | B1 | 11/2003 | Winings et al. | 439/608 |
| 2001/0036762 | A1 | 11/2001 | Payson et al. | 439/320 |
| 2001/0049229 | A1 | 12/2001 | Pape et al. | 439/608 |
| 2002/0076949 | A1 | 6/2002 | Tilbury et al. | 439/97 |

FOREIGN PATENT DOCUMENTS

| | | |
|---|---|---|
| EP | 1 174 885 A2 | 1/2002 |
| FR | 2 527 388 | 11/1983 |
| GB | 295 765 | 8/1928 |

* cited by examiner

HIGH SPEED RECEPTACLE CONNECTOR PART

CROSS-REFERENCE TO RELATED APPLICATIONS

This application is related to U.S. patent application Ser. No. 11/070,313, filed on Mar. 2, 2005, now abandoned, entitled "High Speed Receptacle Connector Part."

FIELD OF THE INVENTION

The invention relates in general to electrical connectors. More particularly, the invention relates to a high speed receptacle connector part.

BACKGROUND OF THE INVENTION

As the speed of electronics increases, electrical connectors are desired that are capable of high speed communications. Electrical connectors provide signal connections between electronic devices using signal contacts. With electronic device miniaturisation and high speed electronic communications becoming more prevalent, the signal contacts will be very closely spaced. Often, the signal contacts are so closely spaced that signal integrity becomes a problem.

One method for improving signal integrity is removing the plastic material in the contact area of the contacts. In this manner air will be the main dielectric in the contact area of the contacts. However reducing plastic material in the contact area of a connector part poses problems regarding positioning and supporting of the contact portions of the signal contacts. Therefore, a need exists for a high speed electrical connector design that reduces the plastic material while maintaining a guaranteed support of the contact portions of the signal contacts.

SUMMARY OF THE INVENTION

The invention satisfies the aforementioned need by providing a high speed receptacle connector part, wherein all plastic material in the contact area of the contact terminals has been removed. According to an aspect of the invention a receptacle connector part is provided, comprising a connector housing and a plurality of rows of receptacle contact terminals disposed within the housing. Each receptacle contact terminal includes two single beam contacts having contact portions with a preload head, and the connector housing comprises a front wall with a plurality of rows of apertures providing access to the contact portions of the contact terminals. Specifically, the connector housing is provided with a plurality of rows of preload ridges, the preload ridges being located at the inner side of the front wall at opposed sides of the apertures, wherein the preload ridges cooperate with said preload heads to support the contact portions of the single beam contacts of each contact terminal in a predetermined preload position.

BRIEF DESCRIPTION OF THE DRAWINGS

The invention will be further explained by reference to the drawings showing an illustrative embodiment of the receptacle connector part according to the invention.

DETAILED DESCRIPTION OF THE INVENTION

Figure 1:
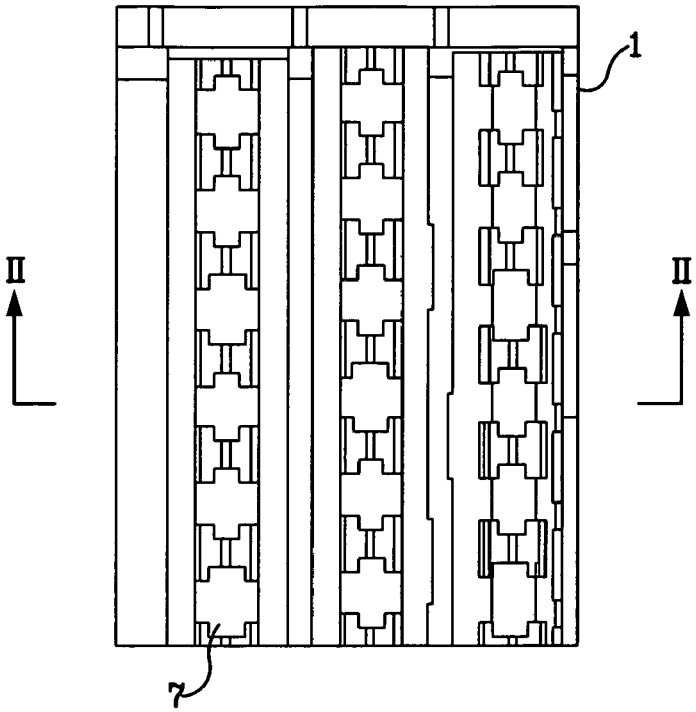
FIG. 1 is a top view of the back side of the connector housing of an exemplary embodiment of the receptacle connector part in accordance with the invention.
Figure 2:
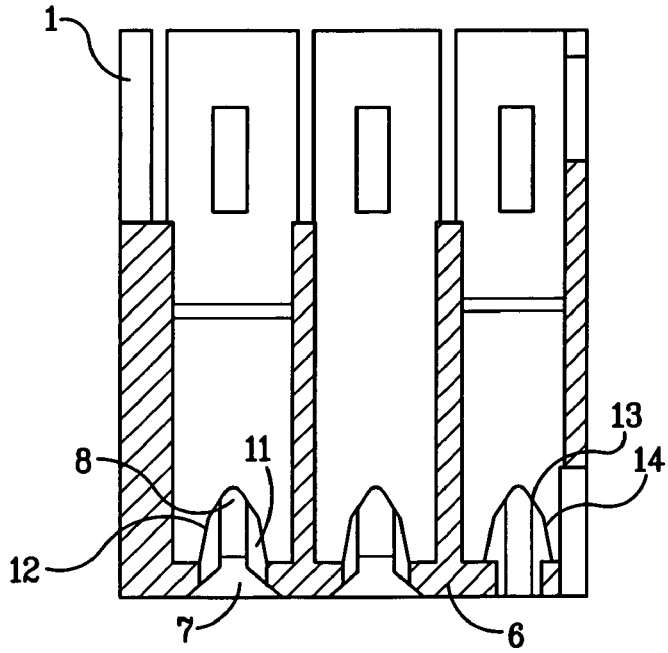
FIG. 2 is a cross-section of the connector housing according to the line II—II in FIG. 1.
Figure 3:
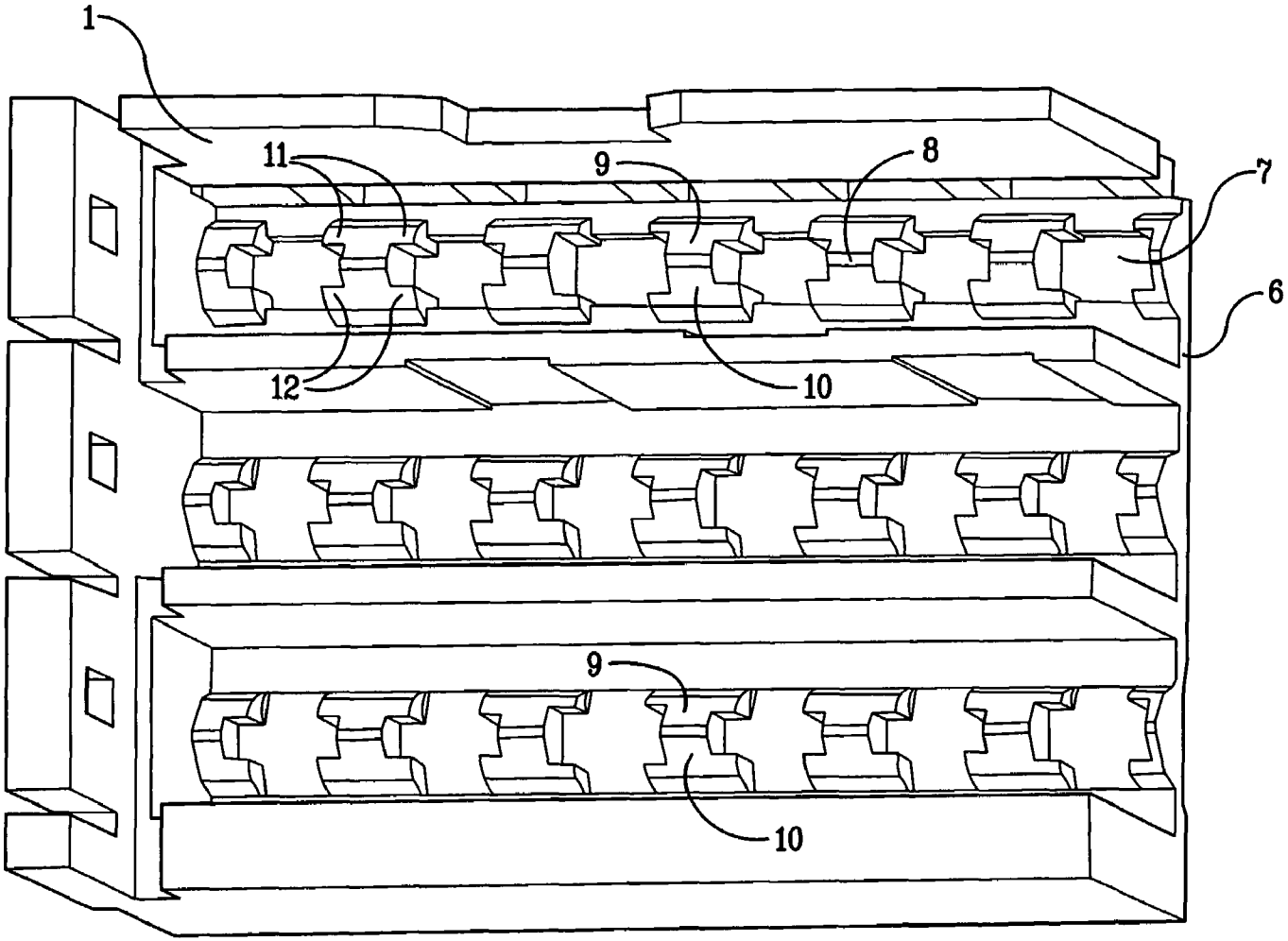
FIG. 3 is a perspective view of the connector housing of FIG. 1.
Figure 4B:
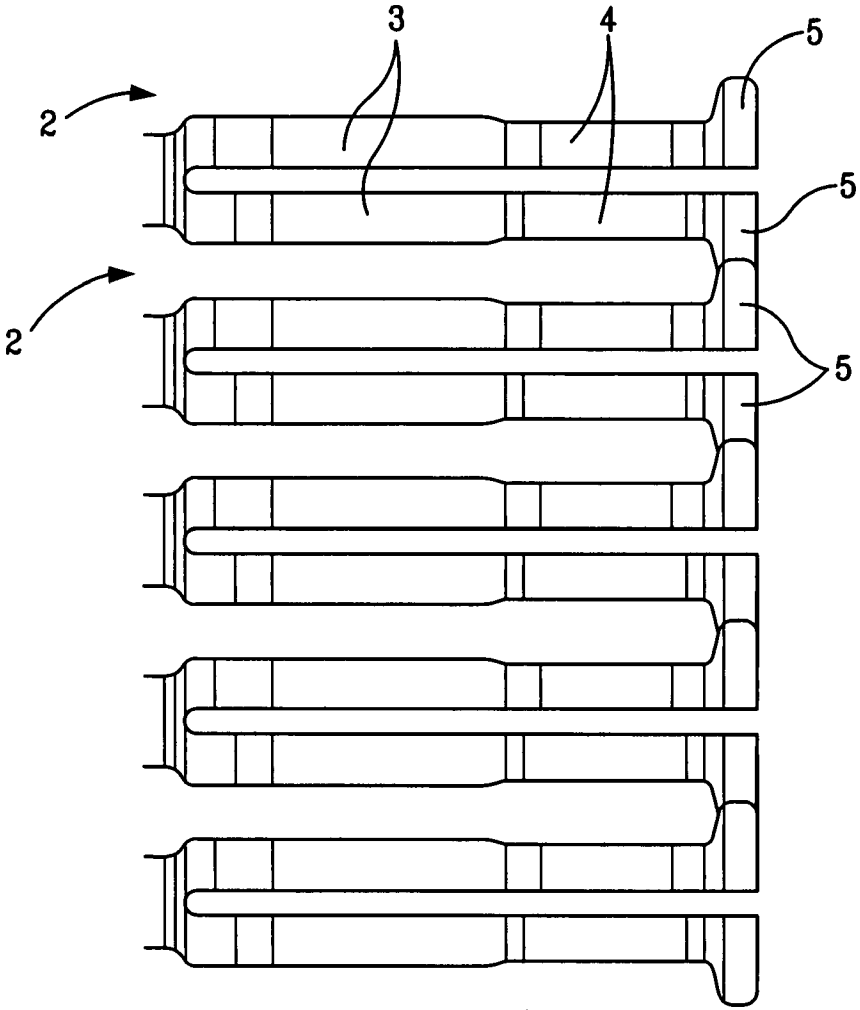
FIGS. 4A and 4B show a top and side views of a row of receptacle contact terminals to be mounted in the connector housing of FIG. 1.
Figure 4A:
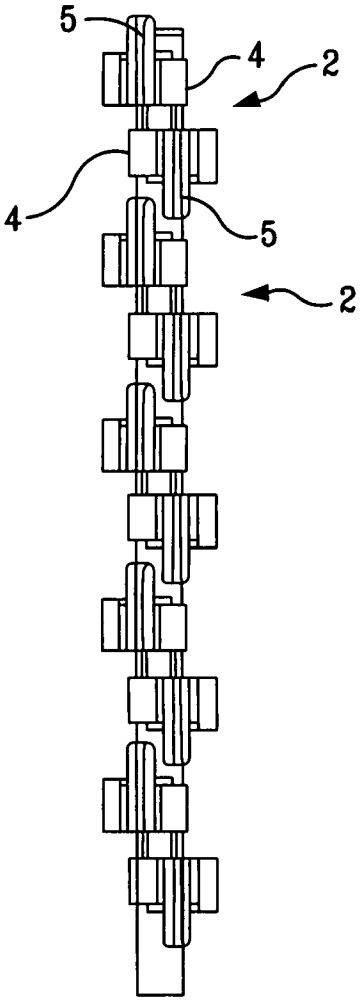
Figure 5:
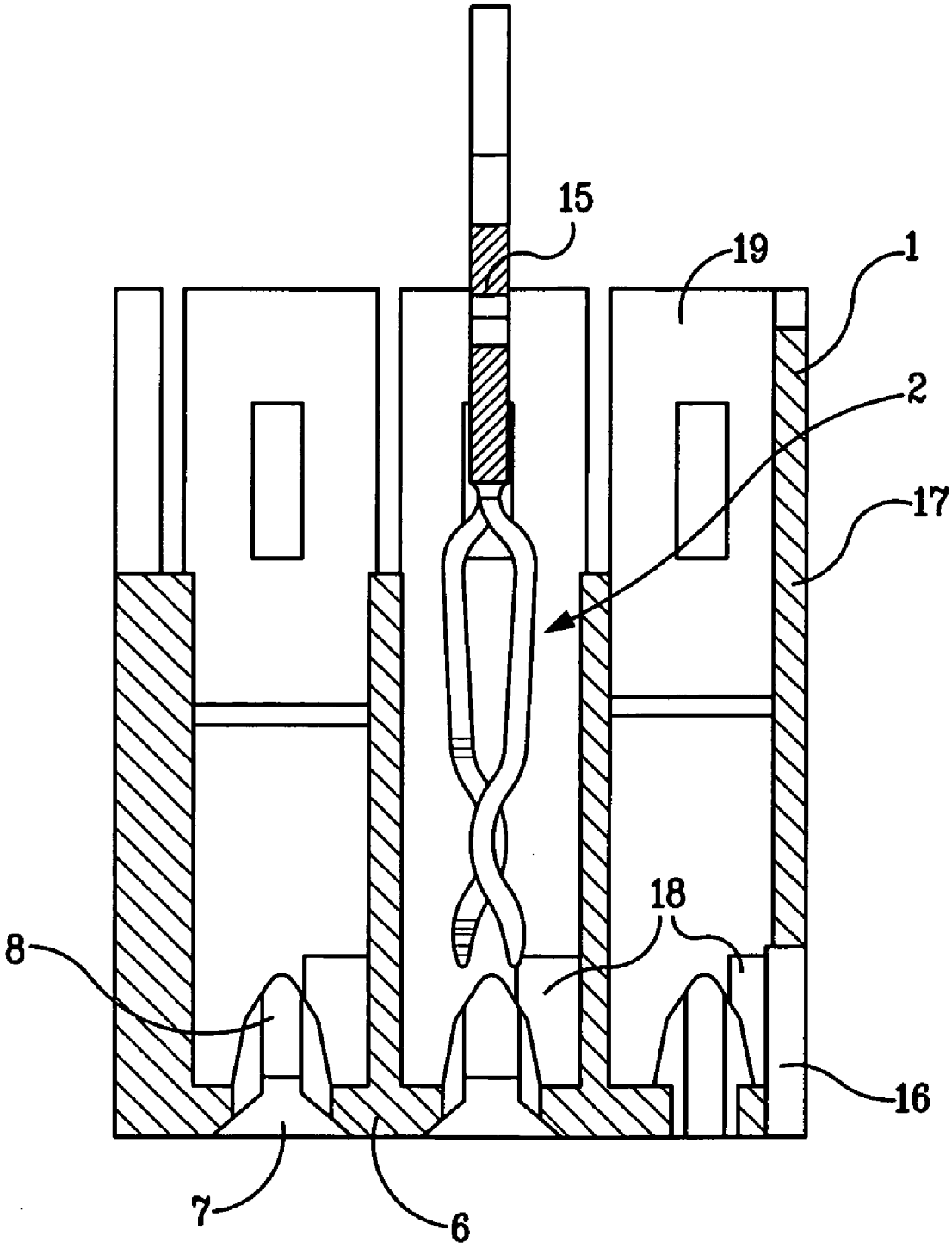
FIG. 5 shows a cross-section of the connector housing of FIG. 1 during the assembly step of inserting a row of receptacle contact terminals.
Figure 6:
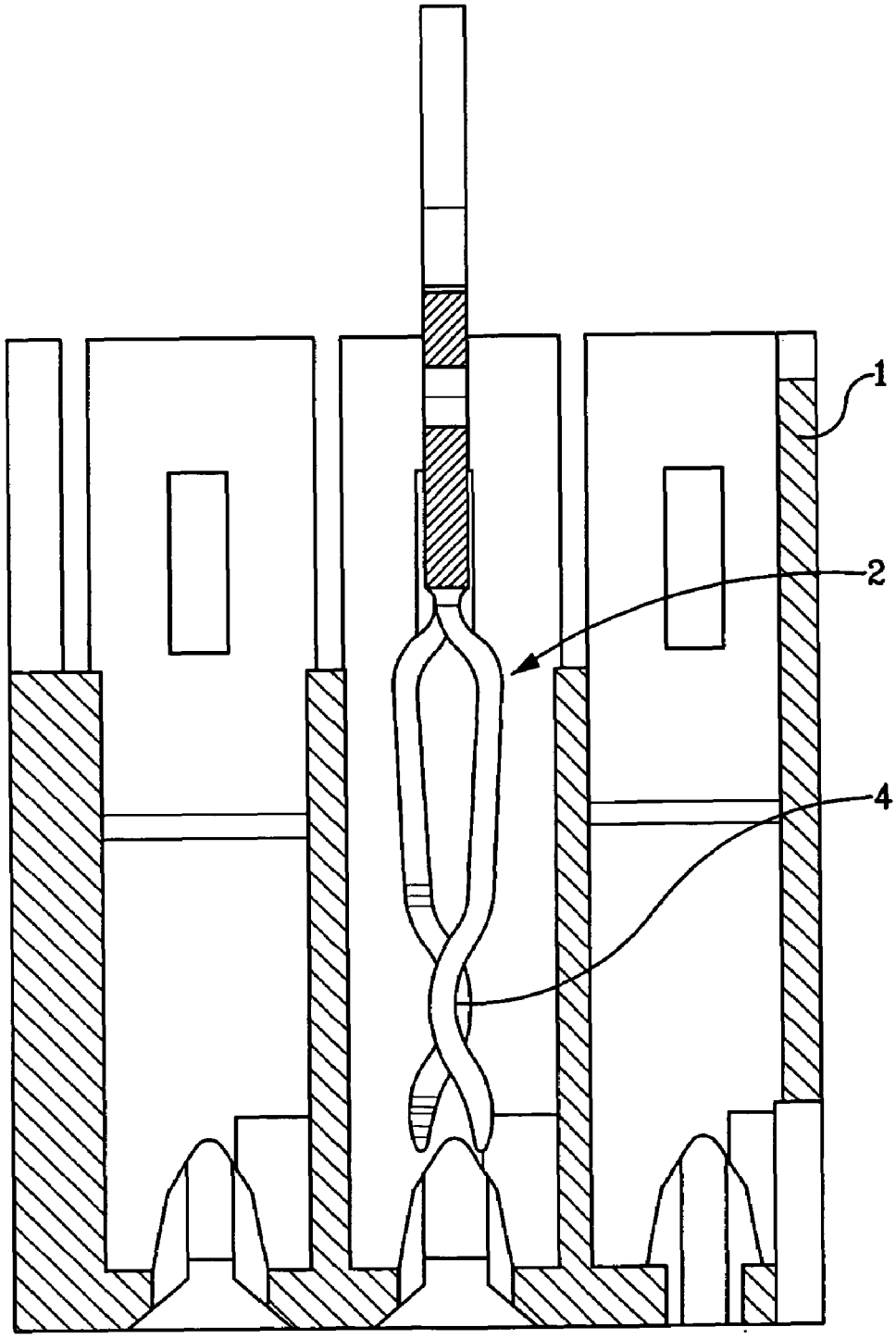
FIG. 6 shows a cross-section corresponding to FIG. 5, wherein the contact portion of the receptacle contact terminals is meeting the preload ridges.
Figure 7:
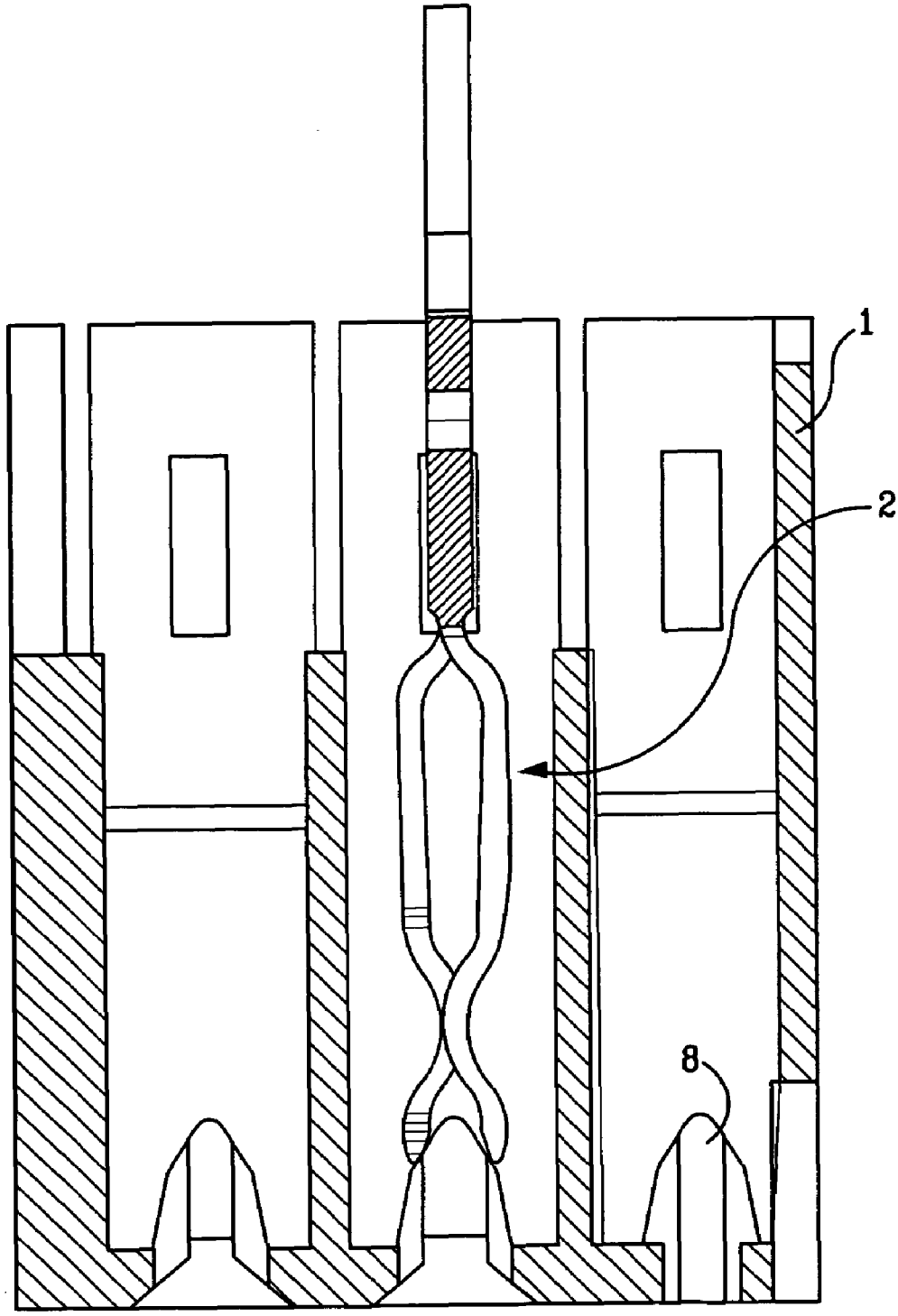
FIG. 7 shows a cross-section corresponding to FIG. 5, wherein the row of receptacle contact terminals is further inserted into the housing.

Referring to the drawings there is shown an embodiment of the receptacle connector part according to the invention, comprising a connector housing 1 shown in FIGS. 1–3, and a plurality of rows of receptacle contact terminals 2 shown in FIGS. 4A and 4B. FIGS. 5–8 show a cross section of the connector housing 1 with one row of contact terminals 2 during an assembly step of inserting the contact terminals 2 into the housing 1. In the drawings the connector housing 1 is shown open at one side for explanation purposes only. Normally, a side wall will be present.

Each receptacle contact terminal 2 includes two single beam contacts 3 having a contact portion 4 with a preload head 5 at its contact tip. As can be seen in the side view of the row of contact terminals 2 in FIG. 4B the contact portions have a kind of hammer head shape, wherein the preload heads 5 of the single beam contacts of one contact terminal 2 extend in opposite directions along the row direction.

Figure 8:
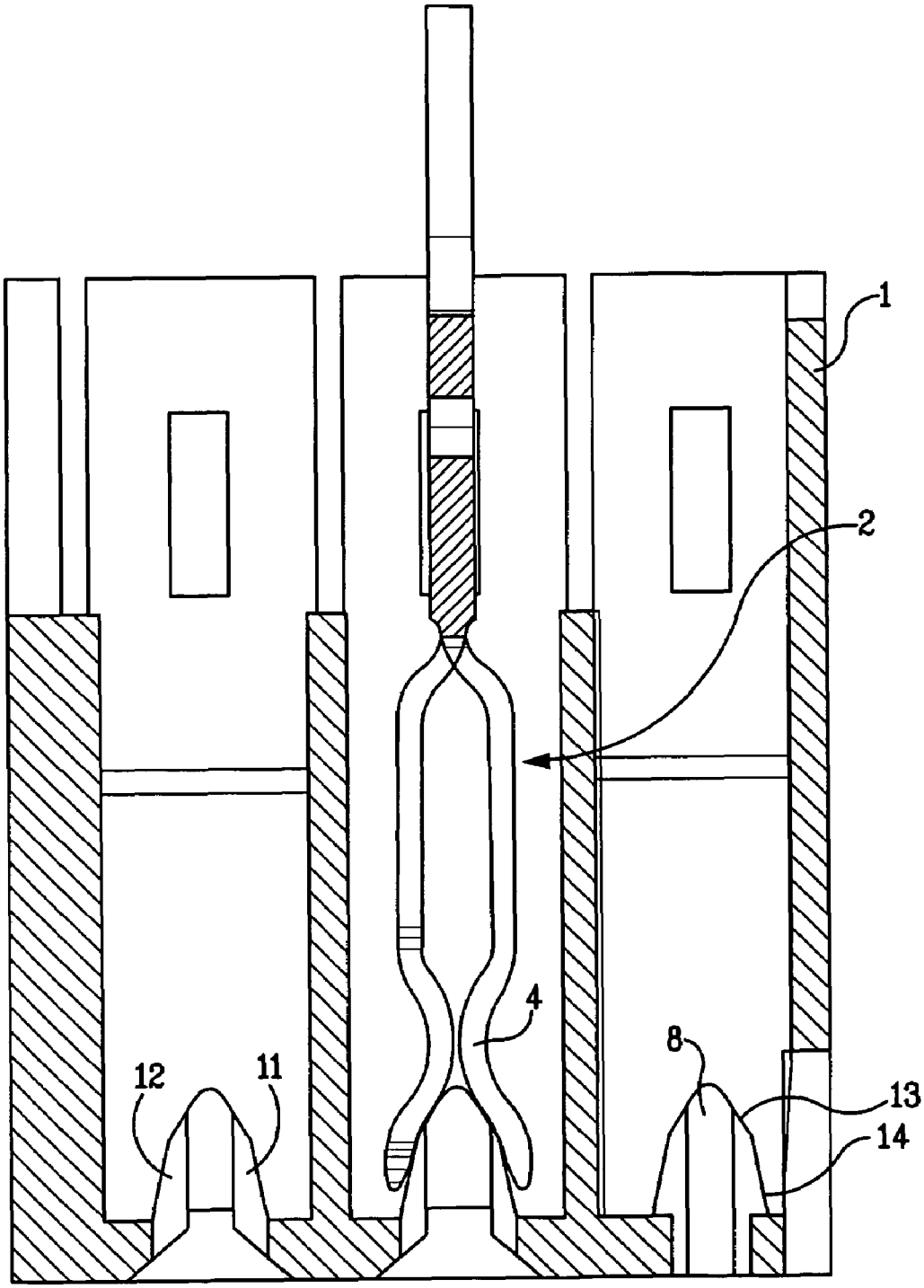
FIG. 8 shows a cross-section corresponding to FIG. 5, wherein the row of receptacle contact terminals is fully inserted into the connector housing.

The connector housing 1 comprises a front wall 6 with a plurality of rows of apertures 7, which apertures 7 provide access to the contact portions 4 of the contact terminals 2. Further, the connector housing 1 is provided with a plurality of rows of preload ridges 8 located at the inner side of the front wall 6 at opposed sides of the apertures 7. As will be explained hereinafter the preload ridges 8 cooperate with the preload heads 5 to support the contact portions 4 of the single beam contacts 2 of each contact terminal 2 in a predetermined preload position shown in FIG. 8. In the embodiment shown in the drawings, one V-shaped preload ridge 8 is located in between each two adjacent apertures 7. The tip of the V-shaped ridges 8 is directed away from the apertures 7. In this manner, each V-shaped ridge 8 shows two ramp surfaces 9 and 10 extending in a lateral and downward direction from the centre line of a row of apertures 7 to one side of the row of apertures. It is noted that lateral direction means transverse to the row direction and downwards means from the upper to the lower side of the views as shown in FIGS. 2 and 8.

Although in the embodiment shown one V-shaped preload ridge 8 is located in between each two adjacent apertures 7, it will be clear that different embodiments and shapes of preload ridges are possible providing ramp surfaces 9,10 extending in the same manner in a lateral and downward direction. For example, separated V-shaped ridges could be provided, each having ramp surfaces 9,10. Such V-shaped ridges 8 can be seen at the upper and lower sides of the top view of FIG. 1. As a further alternative separated preload ridges could be provided, one preload ridge having the ramp surface 9 and the other preload ridge having the ramp surface 10. In the latter case the ramp surfaces 9,10 could extend along the full transverse dimension of the apertures 7.

Preferably, the V-shaped preload ridges 8 are provided with four support extensions 11,12, each two support extensions 11,12 extending in row direction along opposed sides of an aperture 7. In this manner, each aperture 7 is bounded by four support extensions 11,12 directed towards each other at opposed sides of the aperture.

In the embodiment shown in the drawings, the ramp surfaces 9,10 of the V-shaped preload ridges have first and second sections 13,14, extending downwardly at different angles. As can be seen in the cross-sections of FIGS. 2 and 8, for example, the second section 14 extends more steeply downwardly as the first section 13.

Figure 9:
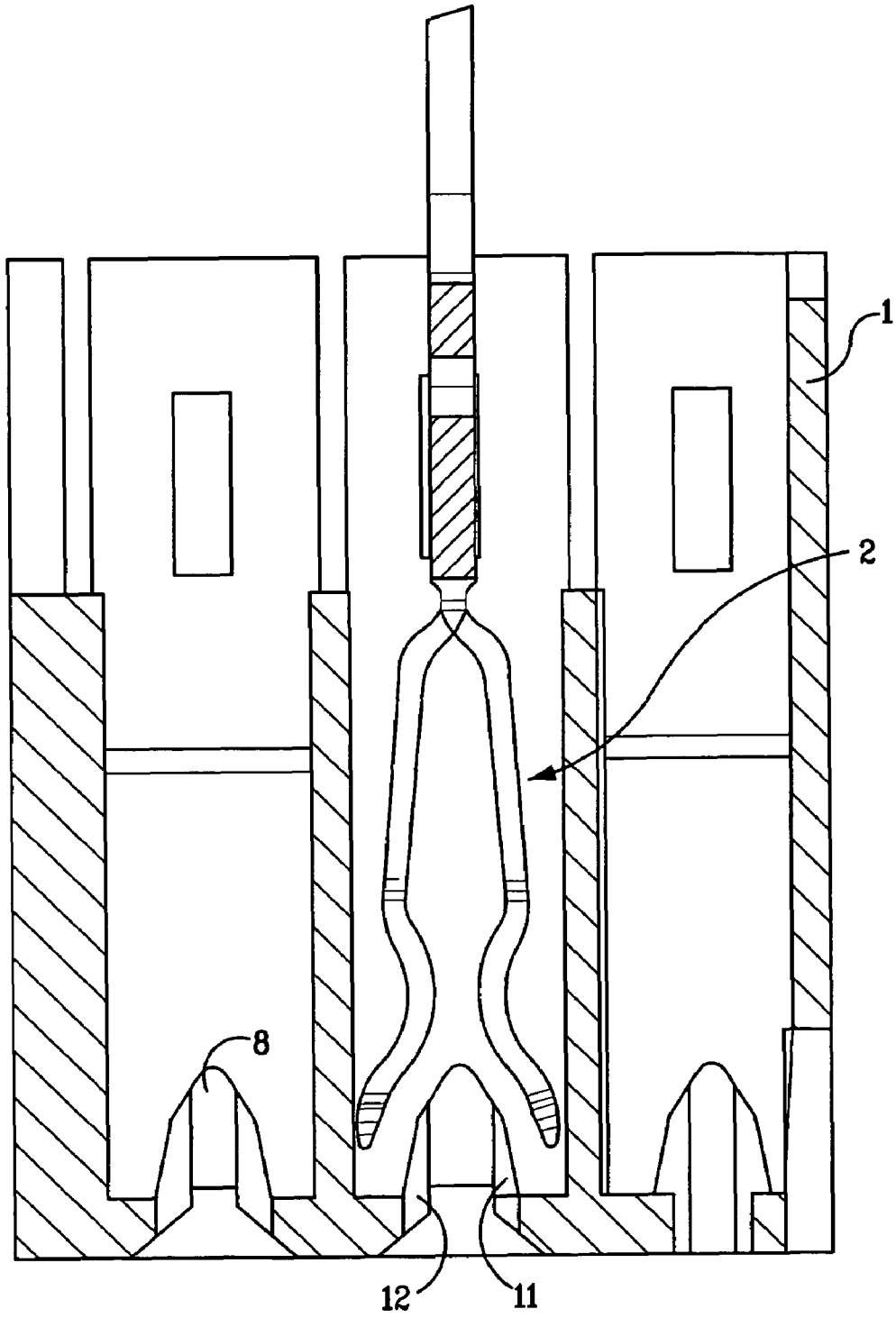
FIG. 9 shows a cross-section corresponding to FIG. 8, wherein the contact portions of the contact terminals are shown in a position as if a plug signal or ground contact has been inserted.

FIGS. 5–8 show subsequent phases of the assembly of the receptacle connector part as described, during which assembly the rows of contact terminals 2 are inserted into the connector housing 1. In the cross-section of FIG. 5 a centre row of contact terminals 2 is in a first phase of the insertion process. It is noted that a row of contact terminals can be provided as an assembly as described in U.S. Pat. No. 6,652,318, wherein the terminals are interconnected by a holder 15 of insulating material. The contact portions 4 are slightly open at the contact tip, so that the tip of the V-shaped ridges 8 can be received in between the contact portions 4. In the cross-section of FIG. 6, the preload heads 5 of the contact portions 4 are meeting with the first sections 13 of the ramp surfaces 9,10 of the V-shapes ridges 8 at both sides of the corresponding apertures 7. During the further insertion of the row of contact terminals 2 into the connector housing 1, the contact portions 4 are further opened as the preload heads 5 move further downwards along the ramp surfaces 9,10. In the last part of the insertion process, the preload heads 5 of the contact portions 4 will be received on the support extensions 11 of the V-shaped ridges 8 as shown in particular in FIG. 8. FIG. 9 shows a cross section of the connector housing 1 as in FIG. 8, wherein the contact portions 4 are moved outwardly as if a contact pin has been inserted through the corresponding aperture 7. In this contacting position the preload heads 5 are lifted off from the support extensions 11,12.

In the final position of the contact terminals 2 as shown in FIG. 8, the contact portions 4 are accurately supported with a guaranteed preload, wherein the contact area of the contact portions 4 is fully free of any plastic material. In this manner the signal integrity performance of the contact terminals 2 is improved. Moreover, the design of the V-shaped preload ridges 8 with the support extensions 11,12 extending along the sides of the apertures 7 in row direction, guarantees a reliable support of the contact portions 4 in the preload position within the full range of manufacturing tolerances of all parts of the receptacle connector part.

Figure 10:
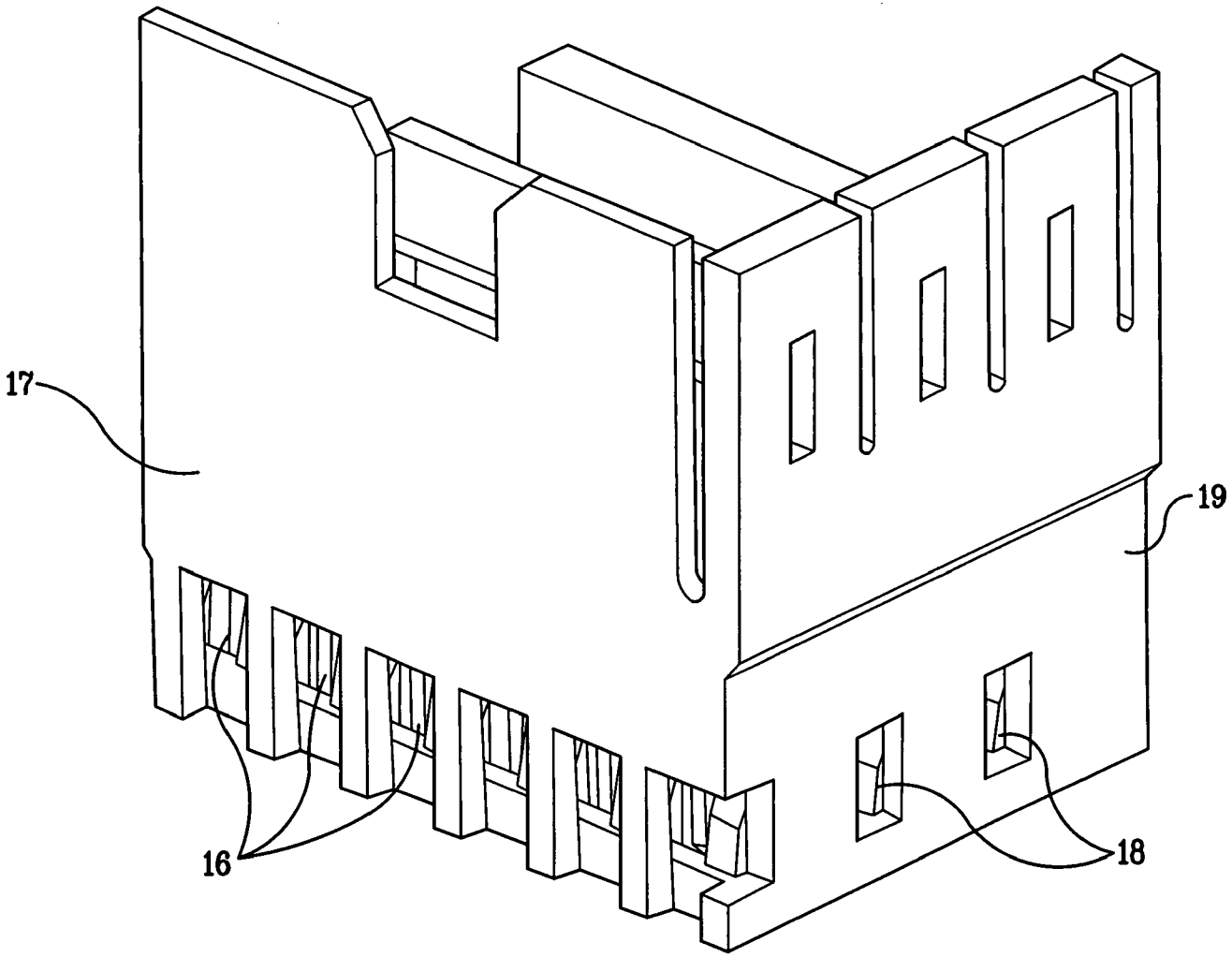
FIG. 10 is a perspective view of the connector housing.

In the embodiment of the receptacle connector part shown, any interference of the contact portions, in particular the contact tip parts thereof, is avoided by providing windows 16 in the sidewall 17 of the connector housing 1. These windows 16 receive the contact portion of the terminals 2 of the adjacent row of receptacle contact terminals. In the same manner windows 18 are provided in the lateral sidewalls 19 of the connector housing 1, only one of which is shown in the drawings. FIG. 10 illustrates the presence of the windows 16 in the sidewall 17 and the windows 18 in the lateral sidewall 19.

It is to be understood that the foregoing illustrative embodiments have been provided merely for the purpose of explanation and are in no way to be construed as limiting of the invention. The invention extends to all functionally equivalent structures, such as are within the scope of the appended claims.

What is claimed is:

1. A receptacle connector part, comprising:

a connector housing; and a plurality of rows of receptacle contact terminals disposed within the housing, each receptacle contact terminal including two single beam contacts having contact portions with a preload head, wherein each of said preload heads extends in each of two opposite directions from said contact portion, and wherein said preload heads at least partially overlap one another, the connector housing comprising a front wall with a plurality of rows of apertures providing access to the contact portions of the contact terminals, wherein the connector housing is provided with a plurality of rows of preload ridges, the preload ridges being located at the inner side of the front wall at opposed sides of the apertures, wherein the preload ridges cooperate with said preload heads to support the contact portions of the single beam contacts of each contact terminal in a predetermined preload position, and wherein the connector housing comprises side walls extending in a row direction, at least one of said side walls having windows for receiving the contact portions of the receptacle contact terminals.

2. The receptacle connector part according to claim 1, wherein the connector housing comprises lateral side walls extending transverse to the row direction, at least one of said lateral side walls having windows for receiving a contact portion of a receptacle contact terminal.

3. The receptacle connector part according to claim 1, wherein each preload ridge is provided with a ramp surface extending in a lateral and downward direction from at least the center of a row of apertures to one side of the row of apertures, wherein the ramp surfaces of the preload ridges at opposed sides of an aperture extend laterally in opposite directions, said ramp surfaces cooperating with the oppositely directed preload heads of a contact terminal.

4. The receptacle connector part according to claim 3, wherein the preload ridges each are provided with a support extension extending along one side of a corresponding aperture in the row direction, the support extensions of the preload ridges at opposed sides of an aperture being directed towards each other at opposed sides of the corresponding aperture, wherein said support extensions support the preload heads.

5. The receptacle connector part according to claim 4, wherein the preload ridges are generally V-shaped preload ridges, and wherein a tip of the V-shape is directed away from the apertures.

6. The receptacle connector part according to claim 5, wherein the V-shaped preload ridges at adjacent sides of adjacent apertures are made as one V-shaped ridge located in between each two adjacent apertures, wherein the ramp surfaces of one V-shaped ridge cooperate with the preload heads of two adjacent receptacle contact terminals in a row of receptacle contact terminals.

7. The receptacle connector part according to claim 6, wherein each V-shaped ridge located in between two adjacent apertures is provided with four support extensions, each two support extensions extending in the row direction along opposed sides of an aperture.

8. The receptacle connector part according to claim 4, wherein the ramp surfaces of the preload ridges have first and second sections extending downwardly at different angles, wherein the second section extends more steeply than the first section.

9. A receptacle connector part, comprising:

a connector housing; and a receptacle contact terminal disposed within the housing, said receptacle contact terminal including two single beam contacts, each said single beam contact having a respective contact portion extending in a lateral direction and a respective preload head extending from the contact portion in a row direction that is transverse to the lateral direction, wherein each of the preload heads extends in two opposite directions from the contact portion, and wherein the preload heads at least partially overlap one another, the connector housing comprising a front wall with an aperture providing access to the contact portions, wherein the connector housing is provided with a pair of preload ridges, the preload ridges being located at the inner side of the front wall at opposed sides of the aperture, wherein the preload ridges cooperate with said preload heads to support the contact portions of the single beam contacts in a predetermined preload position.

10. The receptacle connector part according to claim 9, wherein each said preload ridge is provided with four support extensions, a respective two of the support extensions extending in the row direction along each of the opposed sides of the aperture.

11. The receptacle connector part according to claim 9 wherein each said preload ridge is provided with a ramp surface extending in a lateral and downward direction from at least the center of the aperture to a side of the aperture.

12. The receptacle connector part according to claim 11, wherein the ramp surfaces of the preload ridges extend laterally in opposite directions, said ramp surfaces cooperating with the oppositely directed preload heads of the contact terminal.

13. The receptacle connector part according to claim 11, wherein the ramp surfaces of the preload ridges have first and second sections extending downwardly at different angles, wherein the second section extends more steeply than the first section.

14. The receptacle connector part according to claim 9, wherein each of the preload ridges is provided with a support extension extending along a side of the aperture, the support extensions being directed towards each other at opposed sides of the aperture, wherein said support extensions support the preload heads.

15. The receptacle connector part according to claim 14, wherein each of the preload ridges is generally V-shaped, and wherein a tip of the V-shape is directed away from the aperture.

16. The receptacle connector part according to claim 9, wherein the connector housing comprises side walls extending in the row direction, at least one of said side walls having windows for receiving a contact portion of a receptacle contact terminal.

17. The receptacle connector part according to claim 16, wherein the connector housing comprises lateral side walls extending transverse to the row direction, at least one of said lateral side walls having windows for receiving a contact portion of a receptacle contact terminal.

18. A receptacle connector part, comprising:

a connector housing; and a receptacle contact terminal disposed within the housing, said receptacle contact terminal including two single beam contacts, each said single beam contact having a respective contact portion with a respective preload head, wherein each of said preload heads extends in two opposite directions from the contact portion, and wherein said preload heads at least partially overlap one another, the connector housing comprising a front wall with an aperture providing access to the contact portions, wherein the connector housing is provided with a pair of preload ridges, the preload ridges being located at the inner side of the front wall at opposed sides of the aperture, wherein the preload ridges cooperate with said preload heads to support the contact portions of the single beam contacts in a predetermined preload position, and wherein the connector housing comprises side walls extending in a row direction, at least one of said side walls having windows for receiving the contact portions of the receptacle contact terminal.

19. The receptacle connector part of claim 18, wherein the connector housing comprises lateral side walls extending transverse to the row direction, at least one of said lateral side walls having windows for receiving the contact portions of the receptacle contact terminal.

20. The receptacle connector part according to claim 18, wherein each said preload ridge is provided with four support extensions, a respective two of the support extensions extending in the row direction along each of the opposed sides of the aperture.

21. The receptacle connector part according to claim 18, wherein each said preload ridge is provided with a ramp surface extending in a lateral and downward direction from at least the center of the aperture to a side of the aperture.

22. The receptacle connector part according to claim 21, wherein the ramp surfaces of the preload ridges extend laterally in opposite directions, said ramp surfaces cooperating with the oppositely directed preload heads of the contact terminal.

23. The receptacle connector part according to claim 21, wherein the ramp surfaces of the preload ridges have first and second sections extending downwardly at different angles, wherein the second section extends more steeply than the first section.

24. The receptacle connector part according to claim 18, wherein each of the preload ridges is provided with a support extension extending along a side of the aperture, the support extensions being directed towards each other at opposed sides of the aperture, wherein said support extensions support the preload heads.

25. The receptacle connector part according to claim 24, wherein each of the preload ridges is generally V-shaped, and wherein a tip of the V-shape is directed away from the aperture.

26. A receptacle connector part, comprising:

a connector housing; and a plurality of rows of receptacle contact terminals disposed within the housing, each receptacle contact terminal including two single beam contacts having contact portions with a preload head, wherein each of said preload heads extends in two opposite directions from said contact portion, and wherein said preload heads at least partially overlap one another, the connector housing comprising a front wall with a plurality of rows of apertures providing access to the contact portions of the contact terminals, wherein the connector housing is provided with a plurality of rows of V-shaped preload ridges, the preload ridges being located at the inner side of the front wall at opposed sides of the apertures, wherein the preload ridges cooperate with said preload heads to support the contact portions of the single beam contacts of each contact terminal in a predetermined preload position, wherein preload ridges located between two adjacent apertures are provided with four support extensions, a respective two of the support extensions extending in a row direction along each of the opposed sides of an aperture.

27. The receptacle connector part according to claim 26, wherein each preload ridge is provided with a ramp surface extending in a lateral and downward direction from at least the center of a row of apertures to one side of the row of apertures, wherein the ramp surfaces of the preload ridges at opposed sides of an aperture extend laterally in opposite directions, said ramp surfaces cooperating with the oppositely directed preload heads of a contact terminal.

28. The receptacle connector part according to claim 27, wherein the preload ridges each are provided with a support extension extending along one side of a corresponding aperture in row direction, the support extensions of the preload ridges at opposed sides of an aperture being directed towards each other at opposed sides of the corresponding aperture, wherein said support extensions support the preload heads.

29. The receptacle connector part according to claim 28, wherein the preload ridges are generally V-shaped preload ridges, and wherein a tip of the V-shape is directed away from the apertures.

30. The receptacle connector part according to claim 29, wherein the V-shaped preload ridges at adjacent sides of adjacent apertures are made as one V-shaped ridge located in between each two adjacent apertures, wherein the ramp surfaces of one V-shaped ridge cooperate with the preload heads of two adjacent receptacle contact terminals in a row of receptacle contact terminals.

31. The receptacle connector part according to claim 28, wherein the ramp surfaces of the preload ridges have first and second sections extending downwardly at different angles, wherein the second section extends more steeply than the first section.

32. The receptacle connector part according to claim 26, wherein the connector housing comprises side walls extending in row direction, at least one of said side walls having windows for receiving a contact portion of a receptacle contact terminal.

33. The receptacle connector part according to claim 32, wherein the connector housing comprises lateral side walls extending lateral to the row direction, at least one of said lateral side walls having windows for receiving the contact portions of the receptacle contact terminals.

* * * * *